US008573125B1

(12) United States Patent
Rossow et al.

(10) Patent No.: US 8,573,125 B1
(45) Date of Patent: Nov. 5, 2013

(54) BLAST CONTROL BLANKET

(75) Inventors: Richard Rossow, Longview, TX (US); Cheri McConnell, Longview, TX (US); Vikas Verma, Kilgore, TX (US)

(73) Assignee: Blast Control Systems, L.L.C.

( * ) Notice: Subject to any disclaimer, the term of this patent is extended or adjusted under 35 U.S.C. 154(b) by 0 days.

(21) Appl. No.: 13/549,121

(22) Filed: Jul. 13, 2012

(51) Int. Cl.
*F42D 5/05* (2006.01)

(52) U.S. Cl.
USPC ..... 102/303; 89/36.02; 89/918; 89/921

(58) Field of Classification Search
USPC ..... 89/36.02; 102/303; 428/33, 44, 52, 53, 428/54, 57, 58, 911; 109/49.5
See application file for complete search history.

(56) References Cited

U.S. PATENT DOCUMENTS

| | | | | | |
|---|---|---|---|---|---|
| 1,871,101 | A | | 8/1932 | Waltz | |
| 2,348,387 | A | * | 5/1944 | Hume | 109/49.5 |
| 2,562,005 | A | | 7/1951 | Wenzel et al. | |
| 2,806,426 | A | | 9/1957 | Klokseth | |
| 3,371,604 | A | | 3/1968 | Wikner et al. | |
| 3,491,847 | A | | 1/1970 | Abbott | |
| 3,648,613 | A | | 3/1972 | Cunn | |
| 3,801,416 | A | | 4/1974 | Gulbierz | |
| 3,814,016 | A | | 6/1974 | Leach et al. | |
| 3,870,256 | A | | 3/1975 | Mazella et al. | |
| 4,091,160 | A | | 5/1978 | Koss | |
| 4,429,730 | A | | 2/1984 | Elston | |
| 4,590,714 | A | * | 5/1986 | Walker | 250/585 |
| 4,631,765 | A | * | 12/1986 | Casey | 5/417 |
| 4,738,335 | A | * | 4/1988 | Ishii | 182/129 |
| 4,780,351 | A | * | 10/1988 | Czempoyesh | 428/122 |
| 4,875,549 | A | * | 10/1989 | Denny et al. | 182/138 |
| 4,961,990 | A | | 10/1990 | Yamada et al. | |
| 4,986,389 | A | * | 1/1991 | Halligan et al. | 182/138 |
| 5,076,168 | A | | 12/1991 | Yoshida et al. | |
| 5,703,316 | A | * | 12/1997 | Madden, Jr. | 296/1.07 |
| 5,869,412 | A | | 2/1999 | Yenni, Jr. et al. | |
| 6,076,448 | A | * | 6/2000 | Rexroad | 87/12 |
| 6,077,587 | A | * | 6/2000 | Potok | 428/99 |
| 6,079,454 | A | * | 6/2000 | Lee et al. | 139/383 AA |
| 6,186,274 | B1 | * | 2/2001 | Reynolds et al. | 182/138 |
| 6,226,945 | B1 | | 5/2001 | Henry et al. | |
| 6,720,089 | B2 | * | 4/2004 | Nemchock | 428/660 |
| 6,949,280 | B2 | * | 9/2005 | Brillhart et al. | 428/105 |
| 7,975,594 | B2 | * | 7/2011 | Wartmann | 89/36.02 |
| 8,006,605 | B2 | | 8/2011 | Tunis et al. | |
| 8,100,785 | B2 | * | 1/2012 | Henning | 473/504 |
| 8,361,584 | B2 | * | 1/2013 | Coghlan | 428/58 |
| 2003/0104157 | A1 | * | 6/2003 | Brady et al. | 428/60 |
| 2007/0207689 | A1 | | 9/2007 | Taylor et al. | |
| 2010/0154621 | A1 | * | 6/2010 | Nilakantan et al. | 89/36.02 |

(Continued)

*Primary Examiner* — Bret Hayes
*Assistant Examiner* — Derrick Morgan
(74) *Attorney, Agent, or Firm* — John G. Fischer, Esq.; Paul D. Lein, Esq.; Scheef & Stone, L.L.P.

(57) ABSTRACT

A relatively lightweight, modular, blast control system utilizes a plurality of fabric panels that may be joined to form a matrix or blanket to protect or control the blast. The panels are preferably made from layers of auxetic woven fabric, with each successive fabric layer oriented between 0-90 degrees from the previous layer. The panels may be connected together via a locking mechanism or assembly comprising a cable which runs the length of the perimeter of each fabric panel, and a torque pin rotated about two adjoining cables to form an interlocking connection. The panels connected in this manner form the fully assembled blast control blanket.

19 Claims, 11 Drawing Sheets

(56) References Cited * cited by examiner

U.S. PATENT DOCUMENTS

| | | | | |
|---|---|---|---|---|
| 2011/0203450 | A1* | 8/2011 | Carbajal et al. | 89/36.02 |
| 2012/0097018 | A1* | 4/2012 | Schoenheit et al. | 89/36.02 |
| 2012/0291616 | A1* | 11/2012 | Andrewartha et al. | 89/36.02 |
| 2012/0312151 | A1* | 12/2012 | Patel | 89/36.02 |

BLAST CONTROL BLANKET

TECHNICAL FIELD OF INVENTION

The invention relates generally to a system and method for a blast control blanket for controlling an explosive blast and, more particularly, to a system and associated method for connecting adjacent portions of blast blankets.

BACKGROUND OF THE INVENTION

In industries where explosive or pressure testing may be necessary, it is common to build blast mitigation and protection systems around equipment to be pressure tested. In addition, there may be circumstances where equipment may be overspeed tested which may result in situations where flying objects of small to significant size and velocities up to 1000 feet per second are produced, thus also needing protection.

Similarly, in inherently dangerous industries where there is potential for dangerous explosions or blasts such as oil and gas exploration and production, blast mitigation and protection systems are commonly used to protect critical equipment from damage as well as to help mitigate serious bodily injury or death to well operators and other employees who must perform duties in and around the well. An example of such an inherently dangerous situation is high pressure equipment located on an offshore oil rig. During pressure testing of such equipment, application of a blast mitigation system is necessary in the event an explosive incident occurs.

Further still, there is a general need for explosive or blast protection for equipment or structures in light of various dangers that could pose a threat to these critical assets. All of these scenarios share a need for protection from the highly dangerous situations created by explosive blasts and the ensuing fragments and projectiles.

In the past, various patents have issued relating to apparatuses and methods for providing blast protection or containment utilizing various forms of blankets, tarps and other protective structures. Typically, such apparatuses utilize a modular system comprising a series of panels that are joined together in various fashions to form a unitary blast control blanket suitably sized for providing adequate protection of a critical piece of equipment. However, it is known in the art that such modular systems either suffer from bulky, cumbersome, and frustratingly inconvenient methods for joining various panels together. Such connection methods detract from the overall portability of the protection system, as assembly and disassembly may be time consuming for an operator and is more prone to incorrect assembly.

Furthermore, such prior art modular protection systems typically suffer from substantially weakened protection at the connection points themselves, as the connections are inevitably the weakest portion of an assembled blast control system.

For example, U.S. Pat. No. 3,491,847 to Abbott discloses an explosion cover which constitutes a protective pad adaptable to be secured to a vehicle. The pad includes an elongated sleeve enclosing a stack of flexible ballistic plastic textile material sheets. However, the cover described in Abbott is of a custom size and inconvenient in that the cover must be appropriately sized to the application to be used, and cannot be easily adapted to different size requirements without fabricating an entirely new cover from scratch. Furthermore, Abbott discloses the use of leather straps for extending from the pad for securing the pad to the equipment to be protected.

U.S. Pat. No. 3,870,256 to Mazzella teaches a wire net structure for heavy-duty use which comprises a rectangular mesh of diagonally intersecting wire elements framed by a peripheral cable passing through a set of eyes on each side of the rectangle. Mazzella further teaches that the wire net structure may be used as a blasting mat, several of which may be joined together adjacent one another around a conduit in danger of rupture, the meshing wire elements sliding freely past one another. However, the wire net structure disclosed in Mazzella is heavy and cumbersome to join, while also failing to provide sufficient blast protection in that the wire mesh may easily be penetrated with ballistic matter. Further, the method of joining various wire panels together in Mazzella results in weaker blast protection at the points where the wire net structures are connected to one another.

U.S. Pat. No. 4,590,714 to Walker discloses an insulating tarp made from two membranes which sandwich an insulating material made from fiber glass. The tarp contains a seam structure around all four edges of the tarp which not only fastens the two membranes together, but also holds the highly resilient insulating material in position. At least two adjacent edges of the tarp include a flap that extends along the seam structure along each of the edges. The edges include grommets at regular intervals used to interconnect several of the tarps together. However, the connectors and anchoring system for the tarp disclosed in Walker are substantially weaker than the tarp itself, and thus would fail in the event the tarp of Walker was used to contain large, high energy projectiles.

U.S. Pat. No. 8,006,605 to Tunis discloses a composite armor panel system that has a strike face assembly and a support and containment assembly joined by a bonding layer. The strike face assembly is formed of a hard material layer, which may be comprised of discrete elements or tiles, and a fiber reinforcement bonded to an inner and/or outer surface of the hard material layer which are encapsulated in a matrix material. The tiles and other materials are essentially joined together via a bonding layer which joins the strike face assembly to the support and containment assembly, and includes a mesh embedded in an adhesive material that minimizes cracks through the bonding layer. Thus, the armor system and connection method of Tunis, while suitable for rigid ballistic and blast resistant applications, is not flexible and relatively expensive.

Furthermore, other presently available systems for blast testing generally comprise a concrete bunker or pit built specifically for that purpose. Under this scenario, a pit is typically built for explosive or blast testing purposes and lined with reinforced concrete or block walls with an energy absorbing internal wall made of a material such as wood or steel panels. These concrete bunkers provide excellent protection against blasts and other explosive forces to be tested. However, such testing systems typically take a substantial amount of time and effort to design, and an even greater amount of time and expense to build. For instance, building such a concrete bunker requires significant expenditures to purchase and transport the building materials, as well as a lengthy period of time to physically build the bunker. Furthermore, some large equipment to be tested or protected would require an extremely large enclosure to be adequately tested, and such enclosures typically do not exist as the amount of time and money necessary to support their construction renders them prohibitively expensive and impractical.

In other cases, there may be a need for pressure or explosive testing at a logistically inconvenient work site requiring sufficient blast protection systems to be first installed, such as on a drilling platform. In such instances, it not suitable to install a permanent test structure such as a concrete testing bunker. Rather, there is a need for a blast protection system that may be quickly setup in a cost effective manner that may still provide adequate blast protection for the facility and personnel on site.

Thus, it can be seen that current technologies for ballistic and blast protection systems either provide insufficient protection for large scale blasts and explosions, or are inappropriate, heavy, and cost prohibitive when the structure or equipment to be protected becomes large. In particular, previously known modular blast protection systems suffer from cumbersome connection methods that are not easily assembled and provide substandard protection at the connection points, typically the weakest points of any blast protection system.

What is therefore needed is a relatively inexpensive, easily constructed blast protection system that is also lightweight and portable and therefore transportable for use in different locations. It is also desired that such a system be easily repairable if blast damages is sustained.

SUMMARY OF THE INVENTION

The present invention addresses these problems by providing a relatively lightweight, modular, blast control system which utilizes a plurality of fabric panels that may be joined to form a matrix or blanket to protect or control the blast. The use of fabric panels enables the size of the blast control system to be variable and easily modified depending on specific requirements; the size may be adjusted to become larger or smaller depending on the unique blast control scenario encountered. Each panel may be manufactured from different types of high-strength, cut-resistant fabric that is designed to stretch and absorb a large amount of energy during a blast or other event, and still provide maximum protection as the fabric stretches, particularly at the point where projectiles may impact the fabric from the blast or event. The panels may be connected together via a locking mechanism or assembly comprising a cable and pin assembly in order to form the fully assembled blast control blanket.

In one preferred embodiment of the present invention, the fabric may be an auxetic woven fabric. An auxetic fabric contains materials which have a negative Poisson's ratio. That is, when the auxetic material encounters an external force and is stretched, it becomes thicker perpendicularly in relation to the external force applied. As used in the auxetic fabric panels of the present invention, the individual auxetic fibers comprise two components, wherein one fiber is helically wrapped around a core fiber. Under tension, the wrapper fiber tends to straighten, causing the core fiber to displace laterally in a helical manner. This, in effect, widens and thickens the core fiber when subjected to an external force, such as an explosion. Further, due to the auxetic structure of the fabric and negative Poisson's ratio exhibited, the fabric tends to form a cup for catching and containing both the shockwave of an explosion as well as shrapnel and projectiles.

In a preferred embodiment, the woven fabric may also be manufactured to include multiple layers of auxetic material, with each successive layer laid at a 0-90 degree orientation relative to the previous layer. Because each layer is not oriented parallel to an adjacent layer, greater strength may be provided by the overall panel. The panel may be preferably shaped in the form of a quadrilateral with rectilinear angles, such as a square or rectangle. In a preferred embodiment, the quadrilateral shape of each panel is a rectangle.

A wire rope may be provided which circumscribes the perimeter of each auxetic fabric panel. The wire rope is preferably tensible and malleable such that the wire rope may be twisted or turned and otherwise experience displacement without breaking. The tensibility of the wire rope may therefore allow a change in the shape of the wire rope while simultaneously maintaining the overall structural strength and integrity of the wire rope. The wire rope may further be flexible such that the wire rope may be twisted or turned by hand. In a preferred embodiment, the wire rope may be comprised of a stainless steel cable. In yet another preferred embodiment, the stainless steel cable may be comprised of a plurality of smaller diameter cables twisted together to form the stainless steel cable. The wire rope may be connected to the perimeter of each panel via a series of fabric flaps that extend from the body of each panel and may be folded back towards the body of the fabric panel, thereby forming a perimeter channel for the wire rope while simultaneously allowing access to portions of the wire rope by a connector member, such as a torque pin. In a preferred embodiment, the auxetic fabric flaps surround the wire rope along the perimeter of the fabric panel, with the fabric flaps separated from each other by a series of cutouts at regular intervals along the perimeter of the fabric panel. The flaps are preferably connected to the panel by stitching or sewing the free end of each flap back onto the body of the panel.

To assemble the fabric panels together to create the blast blanket, at least two of the fabric panels are laid side-by-side. Due to the rectangular shape of a preferred embodiment of the panels, the panel may be laid with the long end of the first panel next to the long end of the second panel. Similarly, a short end of the first panel may be laid next to a short end of the second panel. The panels may be laid such that the cutouts that run along the perimeter of each panel are adjacently placed. A connector piece, such as a rigid metal torque pin is provided for interlocking two panels. The torque pin may be preferably shaped to provide locking of the panels while adding as little weight as possible to the overall blast control system. In a preferred embodiment, the locking pin may be a short, cylindrically shaped metal pin having a diameter of approximately ⅜" of an inch. The torque pin is inserted at a perpendicular angle relative to the two wire ropes and in between the space of the first and second panels, at a location where the cutouts are generally matching. The torque pin is then rotated such that it rotates about the axis of the matching wire ropes of the first and second panels at the same time. As the torque pin rotates, the tensible wire ropes of the first and second panels may deform around the torque pin but not break. The torque pin may be rotated for a distance of approximately 180 degrees at which point an end of the torque pin is secured to a side of one of the panels. The torque pin may be secured via a slot attached to the side of one panel and a small pocket attached to the side of the adjacent panel. This process is thusly repeated as many times as necessary at different cutout locations to secure two panels to one another. Additional panels may be connected in similar fashion until the desired matrix of panels are connected together to form the complete blast blanket.

BRIEF DESCRIPTION OF THE DRAWINGS

For a more complete understanding of the present invention, and the advantages thereof, reference is now made to the following descriptions taken in conjunction with the accompanying drawings, in which:

FIGS. 6 and 6A illustrate cutaway views of preferred stitching for perimeter flaps of a fabric panel of the present invention;

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
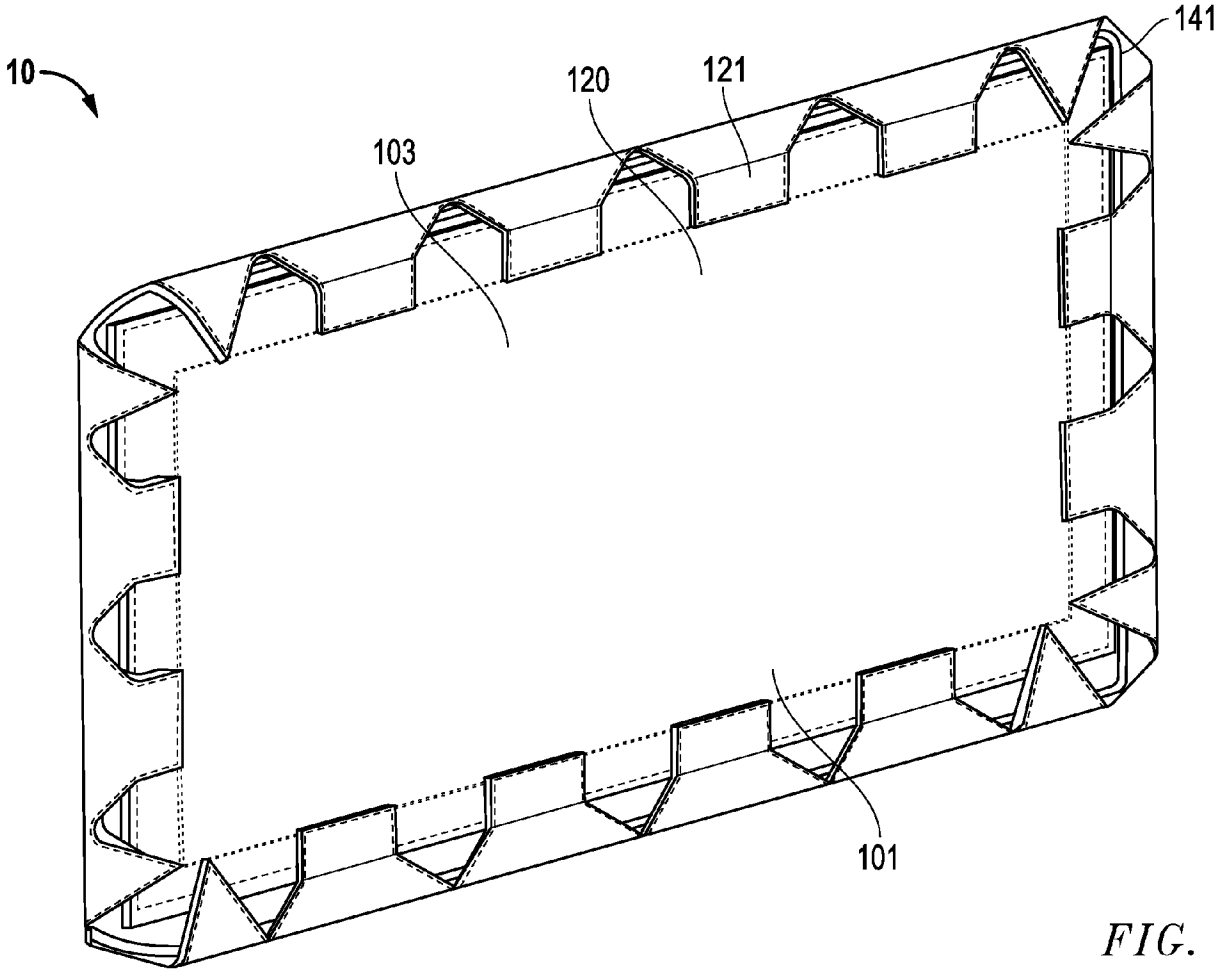
FIG. 1 is an isometric view of an assembled fabric panel of the present invention.

Referring to FIG. 1, there is shown a perspective view of an assembled fabric panel 10 of the present invention. The fabric panel 10 may be comprised of at least two or more layers of a blast resistant fabric. The two or more layers of a blast resistant fabric may be comprised of at least two outer layers, comprising at least a top layer 103 and a bottom layer 105. As shown in FIG. 1, the top layer 103 is visible with the bottom layer 105 behind the top layer 103 and not visible. Each layer of blast resistant fabric may be substantially quadrilateral in shape, and in preferred embodiments of the present invention, may be substantially square or rectangular in shape. Fabric panel 10 may have any length or width depending on the particular application used, but may typically be made on the order of anywhere between 5 feet to 25 feet in either dimension. Fabric panel 10 may additionally have different thicknesses dependent upon the number of layers of blast resistant fabric integrated into fabric panel 10, as well as the type and quality of the blast resistant fabric used, but will generally be less than 3" in thickness. In preferred embodiments of the invention, the thickness of the fabric panel 10 may be approximately 1" in thickness, and would ordinarily be less than 2" in thickness.

One or more inner layers of blast resistant fabric may be further integrated between the top layer 103 and bottom layer 105 to provide additional blast protection properties. Blast resistant fabric may be comprised of any number of materials suitable for containing a blast, and may preferably include nylon fabrics as well as auxetic fabrics and may include fire and chemical resistant fabrics such as basalt, silicone, impregnated fiberglass, insulating materials, Kevlar®, and other high strength materials. In a preferred embodiment, the nylon fabric may be a ballistic nylon fabric, and may be preferably used as the top and bottom layers of the fabric panel 10. Inner layers may be made from an auxetic fabric and may be layered successively in between the top and bottom layers to form the complete fabric panel 10. Preferably, in embodiments of the present invention, the blast resistant fabrics may be assembled together via stitching, and the stitching material may be a ballistic nylon or a stainless steel thread.

Remaining on FIG. 1, fabric panel 10 further shows a series of perimeter flaps 121 which run the length of the perimeter of a single panel. Perimeter flaps 121 may be preformed extensions of a layer of blast resistant fabric, and may be comprised of different shapes depending on the relative location of a particular perimeter flap 121 along the perimeter of the fabric panel 10. It is preferred that all perimeter flaps 121 of a particular fabric panel 10 are folded towards the panel body 20 on the same side of the fabric panel 10. In the embodiment shown on FIG. 1, the perimeter flaps 121 are folded towards the panel body 20 of top layer 103.

Once the perimeter flaps 121 are folded towards the body 20 of the fabric panel 10, they may be preferably attached to the fabric panel 10 via a number of attachment methods. In a preferred embodiment of the invention, the perimeter flaps are attached to the panel body 20 via stitching, and the stitching material may be a ballistic nylon or a stainless steel thread. In other embodiments of the invention, a thread made from a basalt material may be utilized to give the fabric panel further resistance to fire and heat that would typically accompany explosive events. A flexible wire rope 141 may be inserted into the space created by the folding of the perimeter flaps 121 towards the panel body 20, with the wire rope 141 running the length of the perimeter of the fabric panel 10. In a preferred embodiment of the present invention, the wire rope 141 may be made from stainless steel or other sufficiently strong, tensible material. The wire rope 141 may be connected together at opposing ends by a connector.

Figure 2:
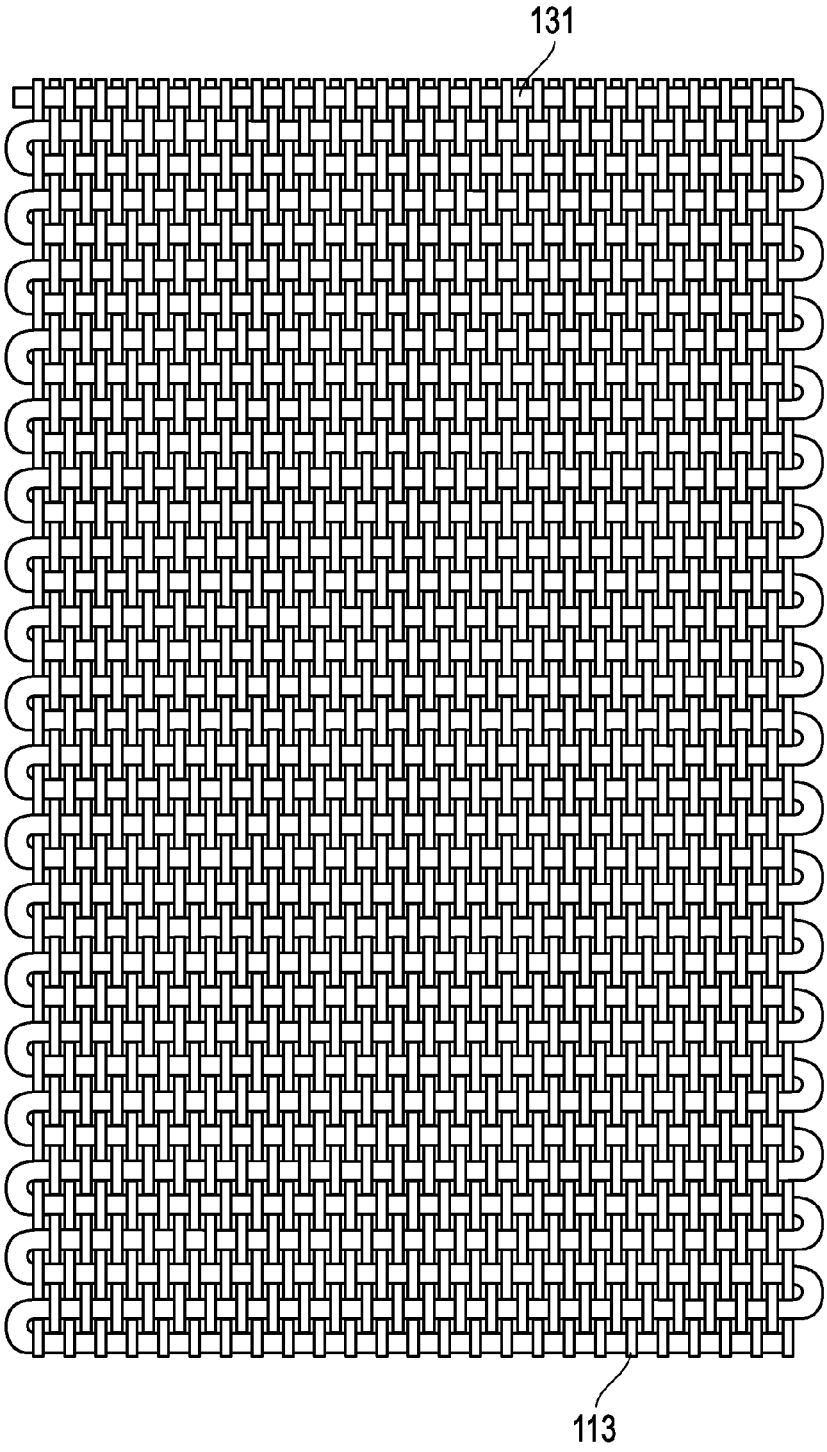
FIG. 2 is a plan view of the weave of an auxetic inner layer in a fabric panel of the present invention.

Turning to FIG. 2, a plan view of an inner layer 107 of the fabric panel 10 is shown Inner layer 107 may be accorded substantially the same dimensions as the assembled fabric panel 10. More specifically, the body of the inner layer 107, which does not include perimeter flaps 121 may be the same or substantially the same dimension as successive inner layers 107, and may be the same or substantially the same dimension as the top layer 103 and bottom layer 105.

Inner layer 107 may be made from any type of material suitable for blast protection, and preferably a high strength, cut resistant, energy absorbing fabric. In preferred embodiments of the present invention, inner layers 107 may be comprised of an auxetic fabric, such as Xtegra® auxetic fabrics available from Advanced Fabric Technologies, LLC in Houston, Tex. Auxetic fabrics are made from materials which exhibit a negative Poisson's ratio. In conventional fabrics, when a fiber of the material is stretched, it tends to contract in the directions transverse to the direction of the stretching, in other words becoming thinner and hence weaker perpendicular to the applied force. However, when a strand or fiber of auxetic material is stretched, it becomes thicker perpendicular to the applied force, thus exhibiting a negative Poisson's ratio. Such auxetic material effectively becomes stronger as it is stretched.

As shown in FIG. 2, inner layer 107 is comprised of an auxetic fabric, which comprises a series of auxetic fibers 131 running in parallel along the surface of inner layer 107. The fibers may be woven together using a weave of various filler materials 137 that typically consist of ballistic nylon, Spectra®, basalt, or other similar materials. The weave of the inner layer 107 may simply be plain woven with wefts of auxetic fibers 131 interwoven with warps of a filler material 137 such as ballistic nylon. Additionally, wraps of Spectra® material may also be interwoven into the auxetic fabric material. Other weaves may be possible, with filler material 137 holding together the auxetic fibers 131. Thus, when inner layer 107 is stretched or pulled in the direction represented by arrow A, such as in an explosive blast or event, it will become stronger at the location of the stretch force. An explanation of how the auxetic fibers 131 becoming stronger due to stretching is further detailed below. Due to the nature of the auxetic materials used in the inner layers 107, conventional cutting mechanisms are ill-suited for cutting the auxetic materials and it is preferable that ultrasonic cutters be used to cut and size the dimensions of the inner layers 107.

Figure 3:
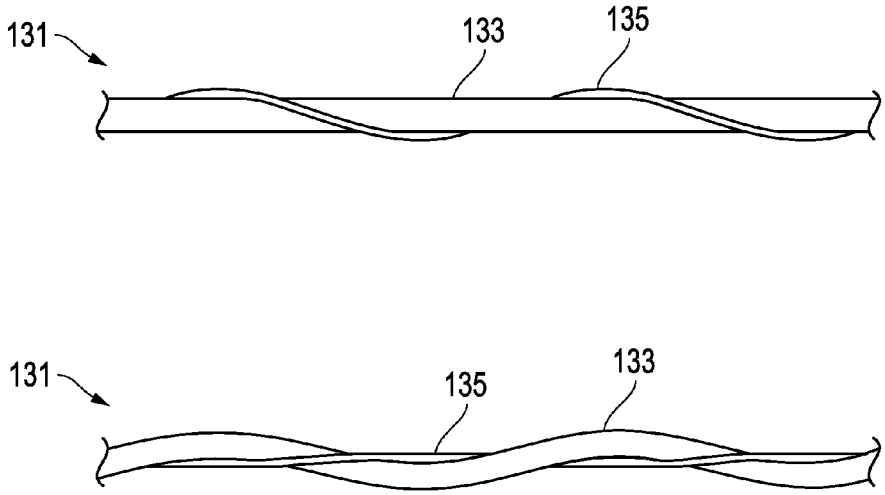
FIGS. 3A and 3B illustrate side views of an auxetic fiber.

Next, at FIG. 3A, a single auxetic fiber 131 of inner layer 107 is shown in a relaxed state. An individual auxetic fiber 131 may be comprised of a smaller wrapper fiber 135 wrapped around a larger core fiber 133. As shown in FIG. 3B, when the auxetic fiber 131 is pulled in the direction represented by arrow A, the wrapper fiber 135 tightens around the core fiber 133, essentially causing the core fiber 133 to disperse in the transverse direction. This deformation of the core fiber 133 results in a thickening of the fabric and may be described as an outward "bulging" of the auxetic fiber 131. It is this thickening of the auxetic fiber that results in greater fabric strength when the fabric is stretched.

As detailed in FIG. 2, the auxetic fibers 131 may be held together by a filler material 137 which is woven into the fabric layer lengthwise against the auxetic fibers 131. Filler material 137 may be comprised of elastic fibers that allow for stretching and deformation of the material, such as a polyfilament filler material. Thus, when core fibers 133 are deformed and thickened as a result of an explosive blast or event, the outward, transverse dispersion of the core fibers 133 results in stretching of the filler material 137 which pulls each auxetic fiber closer to one another. This thickening action is most pronounced at the point of impact on the inner layer 107. That is, the inner layer 107 thickens and tightens the most at the point where there is the greatest amount of force encountered. This results in the auxetic fabric providing the maximum amount of protection where it is most needed.

Figure 4:
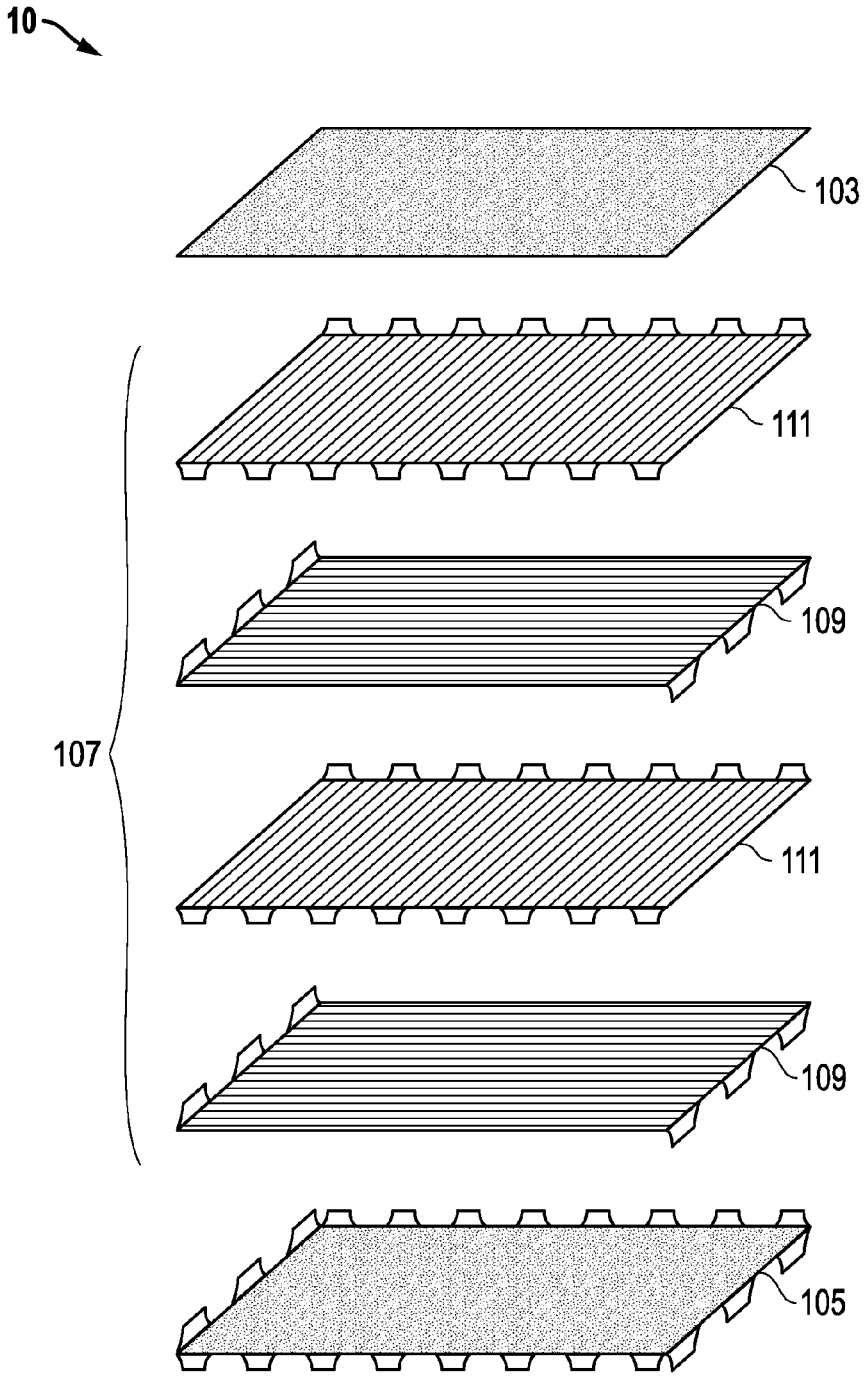
FIG. 4 is an exploded view of a fabric panel of the present invention.

Now turning to FIG. 4, an exploded view of one embodiment of fabric panel 10 is shown. In the embodiment shown, fabric panel 10 is comprised of outer layers including a top layer 103 and bottom layer 105 of a blast resistant fabric, such as ballistic nylon. In other embodiments, other suitable materials may be used for the outer layers, and include heat resistant or flame retardant materials, as well as UV resistant materials for fabric panels that may be exposed to prolonged periods of sunlight. These materials may range from ballistic nylon, which is the standard material, to basalt, which is inert to most hazards. Selection of such materials for the outer layers may be based upon specific needs determined on a case-by-case basis, and does not impact the blast resistance characteristics of the fabric panel 10.

Successively stacked in between the top layer 103 and bottom layer 105 may be several inner layers 107 of blast resistant fabric. The inner layers may comprise both longitudinal layers 109 wherein the auxetic fibers 131 run the length of the inner layer 107 as well as lateral layers 111 wherein the auxetic fibers 131 run the width of the inner layer 107. Each inner layer 107 may contain either auxetic fibers that run in either the longitudinal direction or lateral direction, but not both. Successive inner layers 107 may alternate between longitudinal layers 109 and lateral layers 111, and the auxetic fibers 131 of successive inner layers 107 may differ by 0-90 degrees. Thus, this method of assembling the fabric panel 10 allows for matched pairs of auxetic fiber inner layers 107 to essentially create a lattice-like structure within the fabric panel.

During an explosive event or blast, damage is usually caused by both a shockwave component as well as physical projectiles that may be dispersed by the explosion. During such an event, the net-like structure created by the multiple layers of auxetic fabric allows the fabric to stretch out in all directions more evenly. This in turn provides a cushioning, energy absorbing effect, and gives the fabric panel 10 a tremendous amount of strength. Thus, in preferred embodiments of the present invention, inner layers 107 are integrated into the fabric panel 10 in pairs containing a single longitudinal layer 109 and a single lateral layer 111. In various embodiments of the invention, the fabric panel 10 may contain 2, 4, or 6 alternating inner layers 107, with each increasing number of layer pairings offering additional levels of protection. For example, it has been found that fabric panels containing 2 alternating inner layers 107 may be able to withstand up to 5000 psi of force. For four alternating inner layers 107, the fabric panel 10 may be able to withstand up to 7,000-10,000 psi of force. When six layers of alternating inner layers 107 are utilized, the fabric panel 10 may be able to withstand up to 20,000 psi of force. It has further been found that utilizing an even greater number of inner panels 107 over six layers may result in compromise to the stitching that holds the successive layers together. Thus, should even more force protection be desired, it is more prudent to stack two independent fabric panels 10 on top of one another rather than adding additional inner layers 107.

Due to the unique layering of successive inner layers 107 which creates a net-like structure between top layer 103 and bottom layer 105, the panel body 20 exhibits considerable resiliency against explosive forces and projectiles. In particular, projectiles typically encountered during an explosive blast or event tend to be irregularly shaped particles of relatively low velocity that propagate from the center of the event in multiple directions. In addition to the outward directional forces, these particles generally exhibit rotational forces as the particles spread out. When the projectiles encounter the panel body 20, the net-like construction created by the layering of the inner layers 107 essentially "catches" the low-velocity spinning particle and due to the elastic give provided by the auxetic fabric, allows for the panel body 20 to cradle the particle while simultaneously dissipating the energy and force of the particle. This catching and cradling action of the panel body 20 provides the unique blast protection properties of the blast control blanket.

As can further be seen in FIG. 4, a series of perimeter flaps 121 extend from all four sides of the bottom layer 105. Perimeter flaps 121 also extend from two opposing sides of the inner layers 107, and may generally extend in the same direction as auxetic fiber 131. That is, perimeter flaps 121 run with the auxetic fibers 131 on a particular inner layer 107, and effectively increase the length of auxetic fiber 131 for fibers that extend into perimeter flaps 121. The perimeter flaps 121 may be sized to different lengths and widths according to different requirements, so long as the perimeter flaps 121 contain enough space for wire rope 141 to be fitted through the slot. Furthermore, perimeter flaps 121 may extend substantially toward the panel body 20 to provide additional protection along the perimeter of the fabric panel 10. Perimeter flaps 121 of successive layers of fabric may be appropriately sized to match one another. Thus, when all layers of the fabric panel 10 are aligned and assembled together, perimeter flaps 121 of successive layers will be properly aligned so as to appear to be a single perimeter flap. One advantage of the use of perimeter flaps 121 is that the flaps hold the wire rope 141 in place while providing additional protective material in the perimeter region of the fabric panel 10. The additional protective material improves the resistance of the perimeter region to explosive events. This is important due to the fact that in the perimeter region, there is a greater susceptibility for projectile penetration of the material due to edge tear out from the proximity to the edge of a given blast blanket.

During an explosion, the additional auxetic material that extends into the perimeter flaps 121 of inner layers 107 essentially increases the length of auxetic fibers 131 which engage the explosive event and engage other surrounding fibers to further increase blast resistance properties of the fabric panel 10. In particular, should the explosive event be centered close to the edges of the fabric panel 10 and the perimeter flaps 121, the perimeter flaps 121 may accordingly provide additional protection from the blast due to the added materials in that region. In this manner, the perimeter flaps 121 provide additional protection in the direction of the auxetic fabrics.

Figure 5:
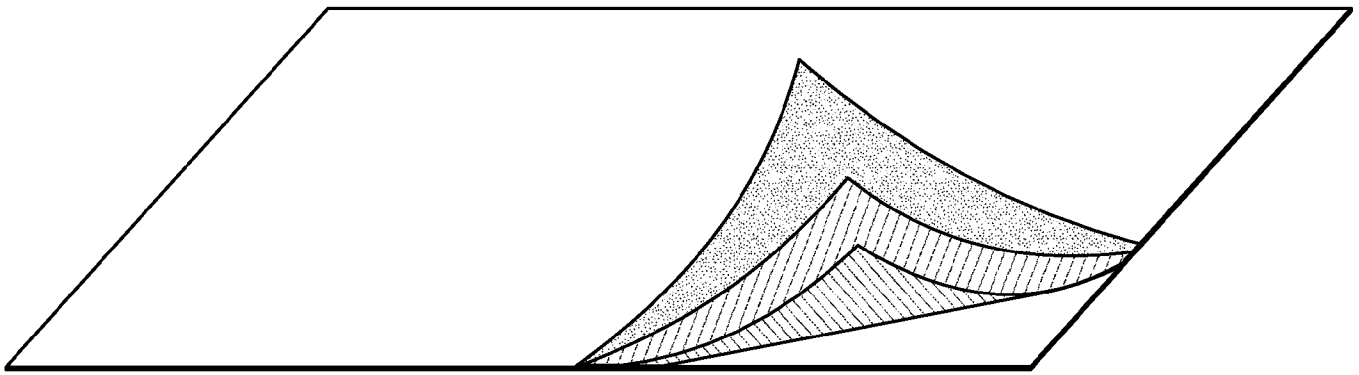
FIG. 5 is a perspective view of a fabric panel of the present invention illustrating the various layers as assembled together.

Turning next to FIG. 5, there is shown a cutaway view of an assembled fabric panel 10 without the perimeter flaps 121. In this figure, two inner layers 107 are shown with a longitudinal layer 109 and a lateral layer 111 which have been laid at an angle between 0-90 degrees relative to one another. Once the requisite number of inner layers 107 have been stacked together to form the desired level of protection, the collection of layers may be assembled together. In an embodiment of the invention, the fabric panel 10 may be stitched together using a double stitching method. A double-needle sewing machine may be used to sew the stitching onto the fabric panel, and the layers may be sewn together using ballistic nylon or black/silver stainless steel thread. Other types of threads may be contemplated depending on the overall configuration of the fabric panel 10. The stitching may be done close to the perimeter of the fabric panel 10, and run along the entire perimeter of the fabric panel 10. In a preferred embodiment of the invention, the fabric panel 10 is held together by double stitching the edges of the perimeter flaps 121. Stitching of the fabric panel 10 at the edges of the layers minimizes restriction of movement for the fabric panel 10 and allows the fabric panel 10 to have the most movement in the body of the panel during an explosive blast or event. Additional movement afforded the fabric panel 10 during an event effectively gives the fabric panel more time and space to engage and channel away the force and energy typically associated with the event.

Figure 6:
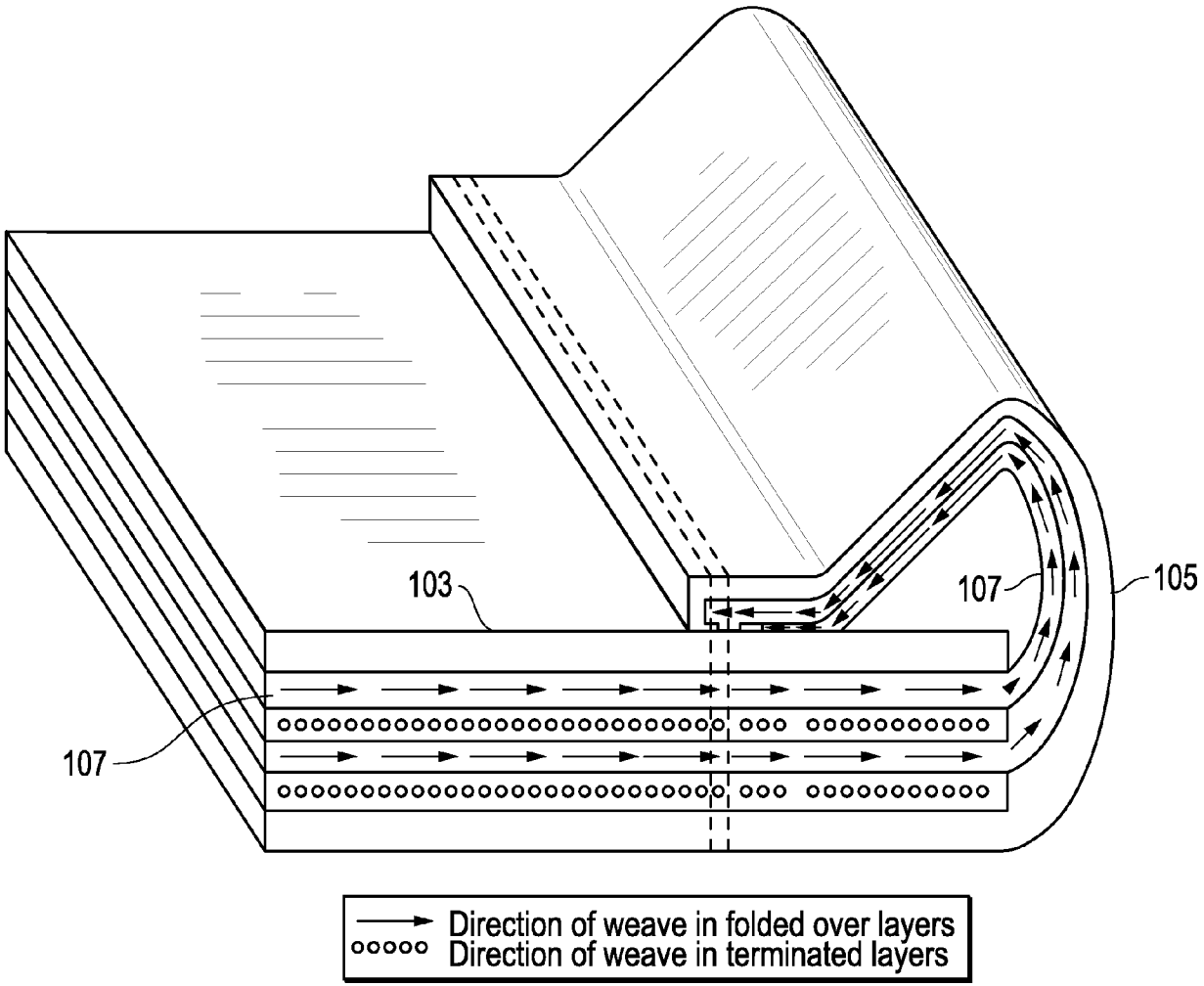

Next at FIG. 6, therein is shown a preferred stitching of the perimeter flaps 121 to the body 20 of the fabric panel 10. Perimeter flaps 121 may be folded back towards the body 20 of fabric panel 10 on one side of fabric panel 10 to form a perimeter channel for threading a wire rope 141. Embodiments of the present invention may utilize a plurality of perimeter flaps 121 which subsequently form a plurality of intermittent channels with channel interruptions formed between each adjacent perimeter flap 121. Once perimeter flaps 121 are folded over towards the body 20 of fabric panel 10, they may be attached to the body 20 of fabric panel 10 via stitching. As can be seen in FIG. 6, perimeter flaps of an assembled fabric panel 10 may be comprised of a bottom layer 105 that has been wrapped around wire rope 141 along with inner layers 107 with weaves of auxetic fibers 131 that that run in the same direction as perimeter flaps 121. Inner layers 107 with weaves of auxetic fibers 131 that do not run in the same direction as a particular perimeter flap 121 may be truncated or terminated at the edge of the fabric panel 10. The termination or cutting of auxetic weaves may be preferably performed with ultrasonic cutters, due to the difficulty of cutting auxetic fibers with conventional cutters. Furthermore, top layer 103 is likewise truncated at the edge of fabric panel 10, and is not folded over. Rather, bottom layer 105 is folded over to cover the inner layers 107 that form the perimeter flap 121.

After the perimeter flap 121 comprised of bottom layer 105 as well as same direction weaves of inner layer 107 are folded over, a double stitching of a ballistic thread may be employed to secure the various layers together. In a preferred embodiment of the invention, various layers may be separately stitched to provide redundant levels of protection in the event one set of seams gives way during an explosive event. Thus, should an explosive event cause a first set of stitching to break, other sets of stitching would remain intact, and would have to be broken in sequence before the structural integrity of the fabric panel would be compromised.

Thus, a first set of double stitching 113 may extend through the edge of the folded over portion of bottom layer 105 which overlaps a first folded over inner layer 107. Further, the first set of double stitching 113 may also extend entirely through the body of the fabric panel 10 in order to fully secure all layers of the fabric panel 10. A second, independent set of double stitching 115 may be used to attach the top layer 103 with the immediately adjacent inner layer 107. This second set of double stitching does not extend all the way through the entirety of the panel body 20. The use of two distinct sets of double stitching 113, 115 gives the fabric panel 10 redundant levels of stitching. Additional sets of independent stitching may be used should additional inner layers 107 be employed by the fabric panel 10, such as embodiments of the invention that utilize up to six inner layers 107. In this manner, the stitching and attachment method of the layers to the fabric panel body 20 may be as strong and resilient as the auxetic fabric itself, and will not be a point of weakness for the fabric panel 10. Thus, during an explosive event, the independent double stitched seams would have to "break-in-order" for the integrity of the fabric panel 10 to be completely compromised. In other words, even if one set of double stitching was to fail, the additional sets of double stitching would still have to be broken in order for the connection of the perimeter flaps 121 to completely fail. And even if all of the seams were to be compromised during an explosive blast or event, it will still greatly decrease the amount of energy in the object it is arresting as the seams are breaking in successive order.

Remaining on FIG. 6, a flexible wire rope 141 may be seen inserted in the space created by the folding of the perimeter flaps 121. Wire rope 141 may be made from a tensible metal of varying thicknesses and composition, and should be of a sufficient strength to support the perimeter of the fabric panel 10, withstand explosive events that it may be subjected to, as well as flexible enough to be twisted and locked by a locking assembly. In a preferred embodiment of the invention, wire rope 141 may be a one-fourth inch diameter braided stainless steel cable. Wire rope 141 may extend the length of the perimeter of the fabric panel 10 and have sufficient slack to allow for twists of the wire rope 141 to be introduced along exposed sections of the wire rope 141 in the cutout sections of the perimeter flaps 121. Sufficient slack may also be present in the wire rope 141 to allow for the assembled fabric panel 10 to be suspended from a structure or other fixture via the wire rope 141. The ends of the wire rope 141 may be connected via a connector assembly or compression fitting to form a complete perimeter to the fabric panel 10. In addition to providing a connection method for joining two fabric panels 10 with a torque pin 153, wire rope 141 acts as an energy absorbing component of the fabric panel 10. That is, during a blast or event, wire rope 141 works to help resist the force and energy associated with the blast or event. Further, wire rope 141 provides a certain amount of "give" to the fabric panel 10, increasing the amount of energy that fabric panel 10 may potentially disperse before the overall integrity of the fabric panel 10 is compromised.

Next, at FIG. 6A, another preferred embodiment of the invention is shown wherein the fabric panel 10 has four inner layers 107, with each inner layer extending into the perimeter flap 121. This is in contrast to the embodiment shown in FIG. 6 where only the inner layers that run in the same direction as the perimeter flaps 121 are extended thereto. Thus, the embodiment shown in FIG. 6A essentially has twice as many inner layers 107 extending into the perimeter flaps 121. In the embodiment shown in FIG. 6A, the additional layers of material in the perimeter flap 121 provide increased strength to the fabric panel 10. Thus, during an explosive blast or event, the increased material allows the fabric panel 10 to better resist the forces associated with the blast, particularly along the edges of the fabric panel 10, where the additional layers to the perimeter flaps 121 are located.

The embodiment shown in FIG. 6A likewise illustrates the use of a first set of double stitching 113 that extends through the edge of the folded over portion of bottom layer 105 as well as two of the folded over inner layers 107. The first set of double stitching 113 also extends entirely through the body of the fabric panel 10 in order to fully secure all layers of the fabric panel 10. A second, independent set of double stitching 115 may be used to attach two other inner layers 107 to the top layer 103. Thus, the embodiment shown in FIG. 6A not only has additional inner layers 107 located in the perimeter flaps 121, but also has the additional layers stitched to the body 20 of the fabric panel 10. It is the combination of the additional layers in the perimeter flaps 121 as well as the stitching of the layers to fabric panel 10 that provides a blast blanket with even greater strength and resiliency to the overall blast control system.

Figure 7A:
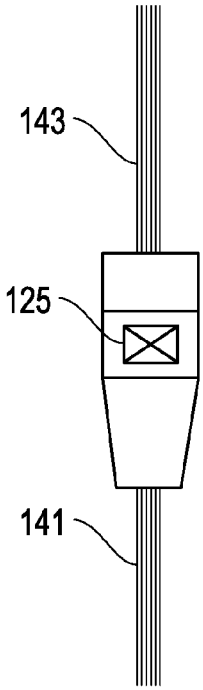
FIGS. 7A-7E show the joining of two ends of a wire rope of the present invention.
Figure 7B:
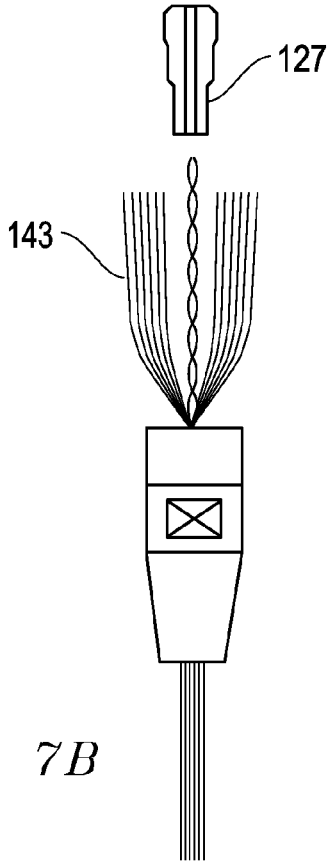
Figure 7C:
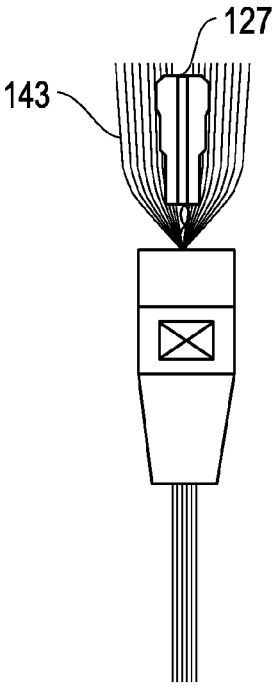

Turning now to FIG. 7A, a compression fitting 125 is shown, for connecting the two free ends of the wire rope 141. Compression fitting 125 may be an elongated metal fitting with a central cavity that allows for maximum movement of the compression fitting 125 and wire rope 141 when inserted within the space created by the series of perimeter flaps 121 of fabric panel 10. In FIG. 7A, a first end 143 of wire rope 141 may be inserted through compression fitting 125 such that first end 143 extends through compression fitting 125 for a short distance. Next, at FIG. 7B, the extended portion of first end 143 may then be unraveled and evenly spread around a metallic sleeve 127. Sleeve 127 is preferably formed of a malleable metal such as copper to provide some tensibility and compression when the sleeve 127 is pressed against the compression fitting 125. The extended portion of first end 143 of wire rope 141 may then be trimmed to be the same length as sleeve 127. At FIG. 7C, the sleeve 127 and extended portion of first end 143 are forcibly depressed into the cavity of compression fitting 125 to create a strong, tight fitting between the first end 143 of wire rope 141 and the compression fitting 125. While portions of the unraveled portion of the wire rope 141 may envelop the sleeve 127, a portion of the wire rope may be inserted through a central cavity of the sleeve 127.

Figure 7D:
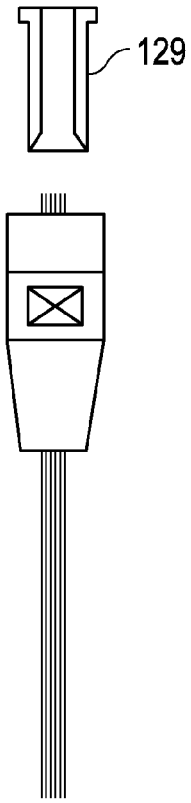
Figure 7E:
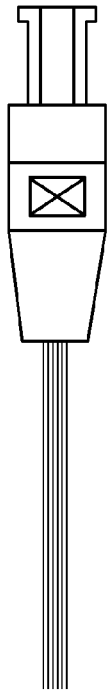

Next, at FIG. 7D, a wedge 129 may be placed on top of the sleeve 127 and extended portion of first end 143. Wedge 129 firmly secures the sleeve 127 into place in the cavity of the compression fitting 125. In FIG. 7E, a top cap 130 that is already connected to an opposite end of wire rope 141 is fitted to wedge 129 as well as the overall assembled compression fitting 125 to complete the connection. The top cap 130 may be threadedly connected to compression fitting 125, and may be more firmly secured through the use of a wrench or other tool. The compression fitting 125 and wedge 129 attached to second end 145 of wire rope 141 may then be fitted to an opposite end of top cap 130, thereby fully completing the connection between first end 143 and second end 145 of wire rope 141. Other methods for connecting the two ends of wire rope 141 are also contemplated within the scope of the invention, and are not limited to the embodiment illustrated in FIGS. 7A-7E.

Figure 8A:
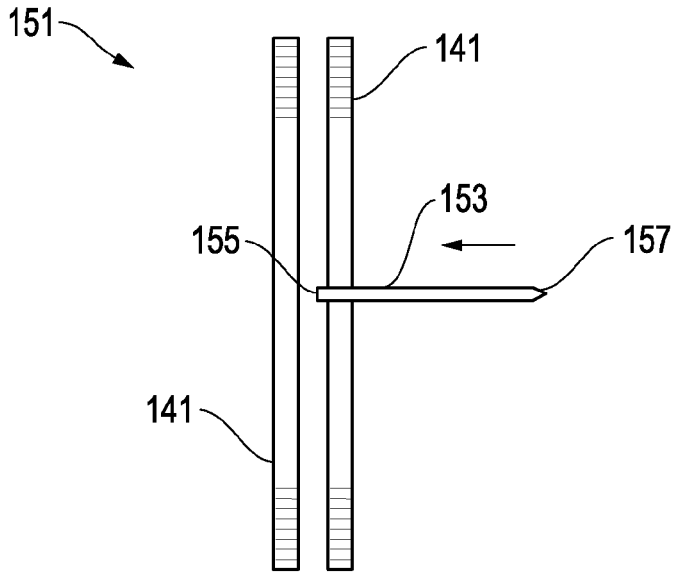
FIGS. 8A and 8B illustrate the interlocking of wire ropes of two fabric panels using a locking mechanism and torque pin.

At FIG. 8A, therein is shown a preferred embodiment of a locking mechanism 151 for connecting two or more fabric panels 10 together to form a fully assembled blast control blanket. In embodiments of the present invention, two fabric panels 10 may be securely fastened together via a series of locking mechanisms 151 which run along adjacent edges of two or more fabric panels 10. In preferred embodiments of the invention where fabric panels 10 are rectangular in shape, similarly dimensioned sides of the assembled fabric panels 10 are laid adjacently. Thus, long sides of two fabric panels 10 should be laid adjacently next to one another, and short sides of two fabric panels 10 should likewise be laid next to one another. Further, cutouts 123 along the perimeter of fabric panel 10 which expose wire rope 141 may be aligned to facilitate proper engagement of the locking mechanism 151.

Next, a torque pin 153 may be inserted between the exposed wire ropes 141 at the location of a matched cutout 123 of the two assembled fabric panels 10. Torque pin 153 may be made of a sufficiently rigid, blast and explosion resistant material, such as stainless steel. Torque pin 153 may be of varying material, size, and weight depending upon the particular fabric panel 10 and locking mechanism 151 employed. Torque pin 153 may have a generally smooth outer surface texture. In other embodiments, torque pin 153 may also have a shaped surface texture comprising a series of longitudinal grooves to assist in restraining torque pin 153 between exposed wire ropes 141. In a preferred embodiment of the present invention, torque pin 153 may be a ⅜" diameter stainless steel rod, and may be approximately one foot in length. Other dimensions for torque pin 153 are also contemplated within the scope of the invention, and may be dimensioned to provide sufficient interlocking and energy absorption capabilities. Preferably, torque pin 153 is inserted between the wire ropes 141 at a perpendicular angle to the wire ropes 141 and substantially parallel to the horizontal plane of the two fabric panels 10. An end 155 of the torque pin 153 is inserted between the wire ropes 141 such that the end 155 extends slightly past the wire ropes 141.

Figure 8B:
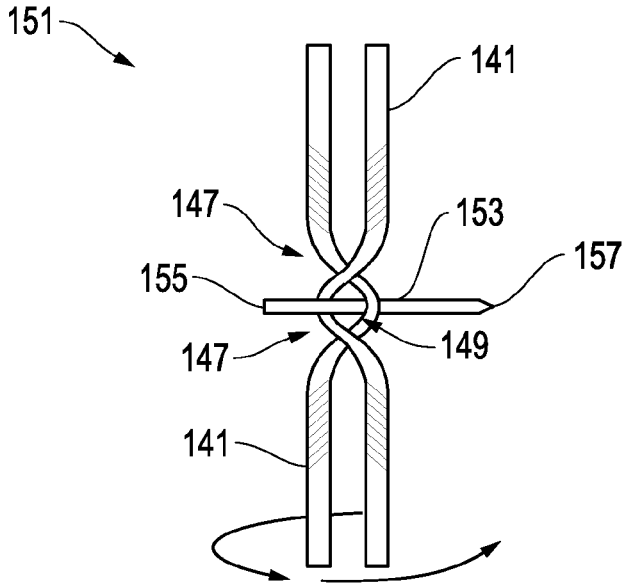

At FIG. 8B, an opposite end 157 of the torque pin 153 is then rotated in the direction of end 155 by approximately 180 degrees such that end 155 and opposite end 157 essentially switch positions. The rotational motion has the effect of introducing a twist 147 in the wire ropes 141 of the two fabric panels 10, effectively intertwining and interlocking the two fabric panels 10 together. Torque pin 153 is located inside a loop 149 formed in twist 147 between wire ropes 141. In other embodiments of the invention, additional rotations in approximate 180 degree increments may be used to adjust the overall tightness of the wire rope 141 as used to connect the two fabric panels 10. A greater number of rotations may Increase the sturdiness of the locking mechanism 151, while a fewer number of rotations will allow for increased flexibility and "give" of the fabric panel, which increases the amount of residency or reactionary time during an explosive event.

After rotating the torque pin 153 such that wire ropes 141 of two adjacent panels 10 are twisted together, the torque pin 153 may be pushed such that either end 155 or opposite end 157 is inserted into a torque pin slot 159 located on one of the two fabric panels 10. After end 155 or opposite end 157 has been inserted into torque pin slot 159, the torque pin 153 may be slid in the opposite direction and the non-inserted end may be pushed into torque pin pocket 161, thereby securing the torque pin 153 within locking mechanism 151. To fully secure the two fabric panels 10 together, multiple locking mechanisms 151 may be utilized such that each pair of matching cutouts along adjacent fabric panels 10 contain a locking mechanism 151.

Thus, the torque pin 153 operates to firmly secure and lock two fabric panels 10 together. Further, torque pin 153 itself also provides blast resistance functionality as it provides for additional energy absorption during a blast or event. That is, the torque pin 153 is capable of absorbing some of the energy associated with a blast or event. Should the stitching on a perimeter flap 121 completely fail, the panels 10 of the overall blast control system are still engaged to the wire rope 141 via the torque pins 153, and the various layers of blast resistant fabric must still be torn through by a blast or event to become completely disengaged from the wire rope 141, thereby comprising the integrity of the overall blast control system. Thus, the use of the torque pins 153 provides the blast control system with an additional amount of force and energy absorption capability which results in several inches of additional "give" during a blast or event.

Figure 9:
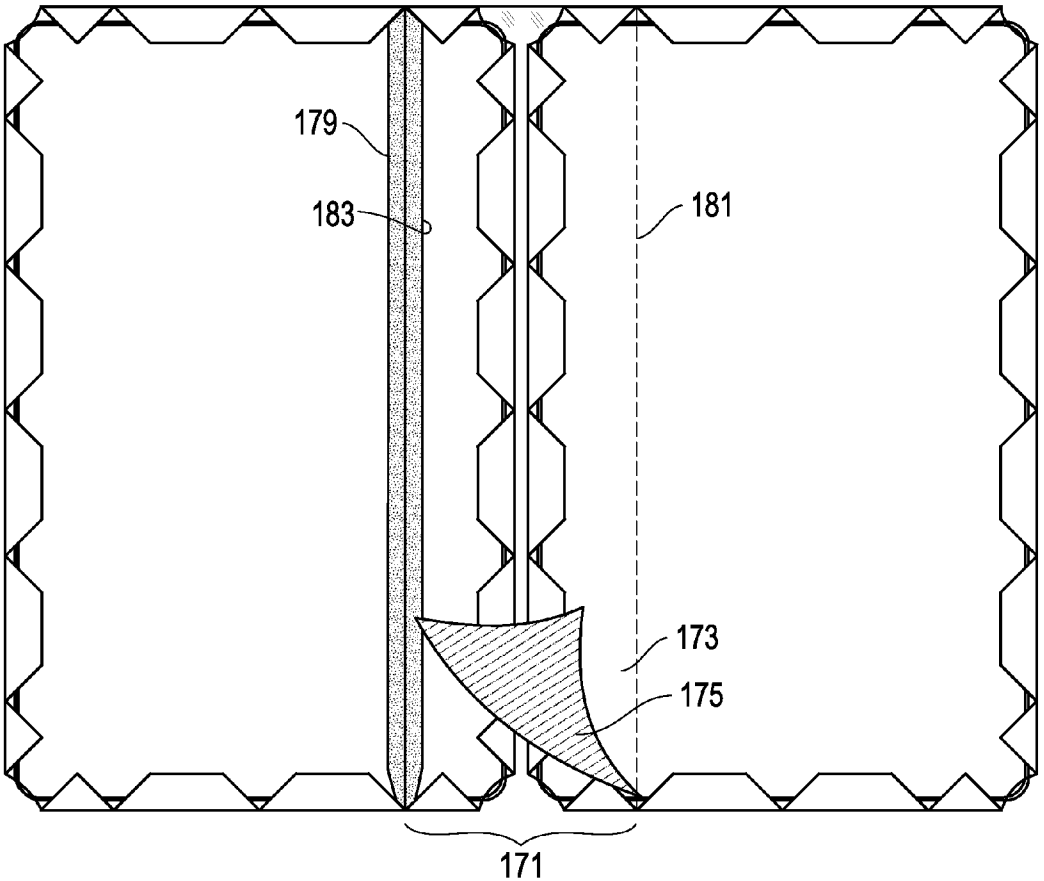
FIG. 9 is a plan view of a splice cover of the present invention.

Turning now to FIG. 9, an embodiment of the invention illustrating the use of an optional splice cover 171 is shown. Once all matching pairs of cutouts along the side of adjacent fabric panels 10 have been secured, a splice cover 171 may be optionally used to provide additional protection to the locking mechanisms 151 and general area between two adjacent fabric panels 10. As shown in FIG. 9, the top portion of splice cover 171 has been omitted from view in order to illustrate the adjacent sides of underlying fabric panels 10 which splice cover 171 protects. Splice cover 171 is essentially a custom shaped fabric panel of similar construction to fabric panel 10, and includes a top layer 173, bottom layer 175 and inner layers (not shown). The layers of splice cover 171 may be preferably stitched together using similar ballistic nylon threading as with preferred embodiments of fabric panel 10. Splice cover 171 may be the same length as the side of fabric panel 10 that it covers, and may be a width to provide sufficient protection to the covered locking mechanisms 151. In an embodiment of the present invention, splice cover 171 may be approximately two feet wide such that the edges 181, 183 of splice cover 171 are approximately one foot from the locking mechanisms 151 when the splice cover is centered over the locking mechanisms 151. Splice cover 171 may be stitched to a fabric panel 10 along a first longitudinal edge 181 of splice cover 171, and have a Velcro® fastener positioned on an opposing longitudinal edge 183 of splice cover 171. In other embodiments of the present invention, both edges 181 and 183 may be secured to the fabric panels 10 with the use of Velcro® fasteners, without the need for stitching splice cover 171 directly to the fabric panels 10. Furthermore, various other methods may be used to fasten splice cover 171 to fabric panel 10, including buttons, hooks and the like.

The advantage of providing splice cover 171 on top of the locking mechanisms 151 is that it provides additional blast resistant material in the regions between adjacent fabric panels 10 where there are openings for the torque pins 153. Splice cover 171 ensures that the thickness of the material in the region of the openings between adjacent fabric panels 10 is the same as the thickness of the material in areas of the fabric panels 10 where there are no openings. In addition, because the overall size of splice cover 171 is larger than the opening, it may provide additional material in the immediate area surrounding the opening. Thus, the immediate area around splice cover 171 may have up to double the number of blast resistant fabric layers.

After engaging all locking mechanisms 151, as well as attaching the optionally available splice cover 171, the fully assembled blast control blanket may be mounted or hung up in an area where explosive testing is being performed or may be utilized in environments where blast protection is needed. The blast control blanket may be hung using the cutouts in the perimeter flaps 121, and may be mounted in a number of ways via the exposed sections of the wire rope 141. While the blast control blanket may be hung with either the top layer 103 or bottom layer 105 facing the direction of the blast or event, it is preferred that the side containing locking mechanism 151 as well as splice cover 171 faces the direction of the blast or event in order to provide maximum possible protection. However, in the event that the side of the blast control blanket opposite the locking mechanisms 151 and splice cover 171 is positioned to face the direction of the blast or event, blast control blanket may still provide substantially the same amount of protection, with the blast control blanket not realizing the additional protection provided by the locking mechanisms 151 when they face the event.

Figure 10:
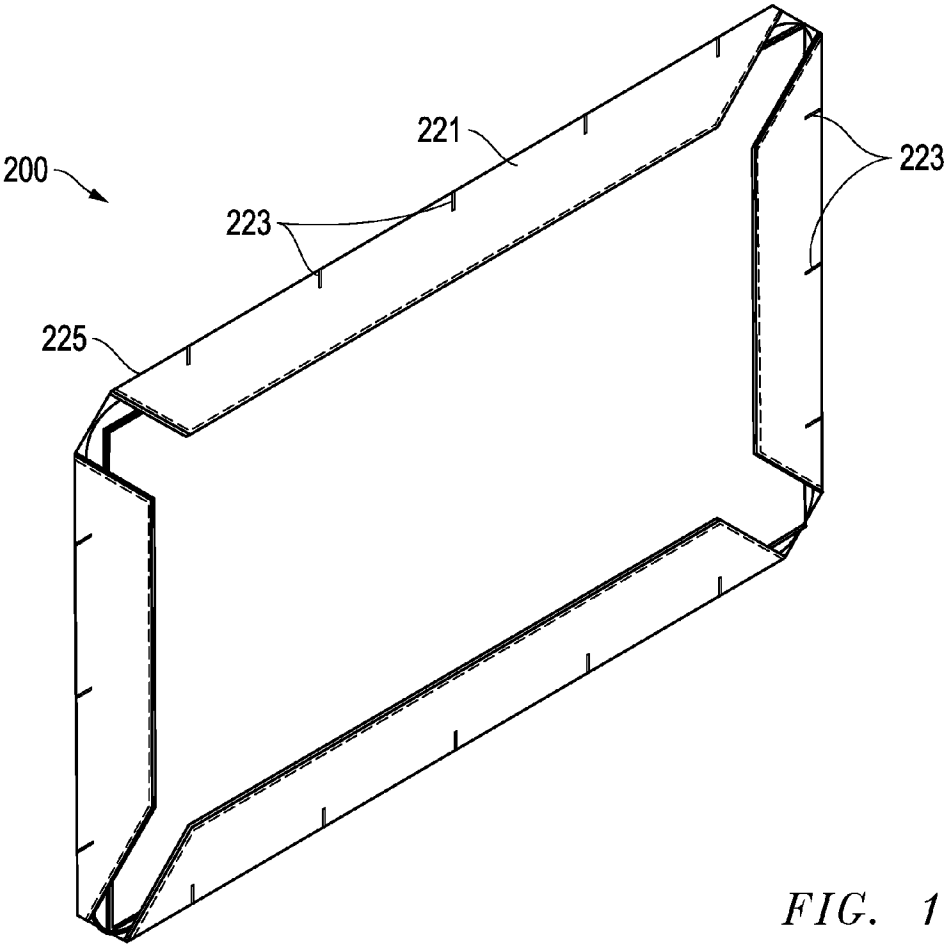
FIG. 10 is an isometric view of another embodiment of the perimeter flaps of the present invention.

Next, at FIG. 10, another embodiment of the present invention is shown with a fabric panel 200 having perimeter flaps 221. Perimeter flaps 221 run the length of the perimeter of a single panel 200, and are generally partitioned into individual sections along each side of the panel 200. Perimeter flaps 221 may be pre-formed extensions of a layer of blast resistant fabric, and may be comprised of a generally contiguous segment along each side of panel 200. A series of slits 223 are spaced apart along the edges of the perimeter flaps 221. Slots, rather than slits 223 may also be used in other embodiments of the invention. As with perimeter flaps 121, perimeter flaps 221 may be folded back towards the body of the fabric panel 200. It is preferred that all perimeter flaps 221 of a particular fabric panel 200 are folded towards the same side of the fabric panel 200. Furthermore, as illustrated in FIGS. 6 and 6A, the perimeter flaps 221 may contain a varying number of inner layers 107 with either alternating inner layers 107 being folded into the perimeter flaps 221, or all inner layers 107 being folded into the perimeter flaps 221.

Once the perimeter flaps 221 are folded towards the body of the fabric panel 200, they may be stitched to the panel body, utilizing the same stitching material as fabric panel 10, such as a ballistic nylon or a stainless steel thread. A flexible wire rope 141 is similarly inserted into the space created by the folding of the perimeter flaps 221 along the perimeter of the fabric panel 200. In place of the cutouts 123 used in perimeter flaps 121, perimeter flaps 221 have a series of narrow slits 223 which are spaced along the edges 225 of fabric panel 200 and expose wire rope 141 to facilitate the use of a locking mechanism 151 and torque pin 153 to lock adjoining sections of two fabric panels 200.

To lock panels 200 together, two fabric panels 200 are laid adjacently with matching slits 223 adjacent to one another, with the slits 223 providing access to the wire rope 141. A torque pin 153 is inserted into the slit 223 in similar fashion as the insertion of torque pin 153 into cutouts 123. The torque pin is then rotated about 180 degrees to twist the wire ropes 141 together, with the toque pin 153 secured in place with the use of a torque pin slot and pocket (not shown). During an explosive blast or event, the perimeter flaps 221 of panel 200 provide even greater resiliency and energy absorbing capability due to the additional material present in the contiguous section of perimeter flaps 221. As compared to the embodiment of the present invention illustrated in FIG. 1, the use of smaller slits 223 reduces the exposure of the wire rope 141, which allows the perimeter flaps 221 to almost completely surround and secure the wire rope 141. In addition, the smaller slits 223 reduce the amount of slack in wire rope 141 in the region around locking mechanism 151, which provides a tighter, more secure connection. Further, addition of more stitched material around the locking mechanism 151 reduces the load in the region and improves the structural integrity of panel 200 in this region. In addition, the contiguous structure of perimeter flaps 221 allows for greater energy absorption capability. If the stitched seam does begin to tear out in the region around locking mechanism 151, the continuous nature of the stitching may allow for isolated seam failures and continue to hold the wire rope 141 in place.

Based on experimental testing, the breaking strength of an inner layer 107 comprising auxetic fibers is approximately 600 lb/in. In addition, testing on an embodiment of the blast control blanket having four inner layers 107 was performed. With respect to this testing, allowable velocities (V50 values) for the blanket were calculated. To calculate a V50 value, the four highest-velocity passes and the four lowest-velocity fails were averaged to obtain a 4-point V50 of 726 ft/s. If three passes and three fails are used, the 3-point V50 is 732 ft/s. If two passes and two fails are used, the 2-point V50 is 740 ft/s. Finally, if one pass and one fail are used, the 1-point V50 is 750 ft/s.

It will be appreciated that the blast control blanket may be quickly set up and suspended in an area where pressure testing is being performed, such as on an oil platform. The blast control blanket may further be used to protect staff and workers against potential hazards such as blowouts and other dangerous explosive events, and shield personnel working close to dangerous equipment that is in operation or in testing. In this manner, adequate levels of protection may be afforded workers on an oil platform, allowing such workers to continue working on tasks without compromising their safety, and avoiding downtime usually associated with such pressure testing. In another instance, the blast control blanket may be used in a working location wherein safety regulations limit the proximity in which a worker may operate a vehicle next to an oil rig. By quickly setting up the blast control blanket at the working location, the worker may be able to operate his vehicle closer to the oil rig while still adhering to applicable safety regulations and permits.

In still other instances, the blast control blanket may be used in conjunction with conventional concrete testing rooms to provide an additional layer of protection, as concrete walls are well suited to providing protection against compression loads, but lack tensile capability. When the present invention is used in conjunction with a concrete wall, the combined blast protection system is able to provide improved blast protection as to both compression and tension loads as well as improved projectile damage protection. This is due to the blanket material adding tensile strength to the overall structure.

Another advantage of the blast control blanket is that it may be utilized in other situations where space restrictions limit the use of conventional blast protection systems, or render them impractical. Further, due to the relatively light weight of the blast control blanket, the system may be easily transported to locations normally unworkable for setting up conventional concrete blast testing systems, such as offshore oil rigs, and other remote drilling sites. Due to the fabric nature of the blast protection blanket, the system exhibits a flexibility not present in conventional protection systems and may be custom designed for varying applications, as individual fabric panels may be molded into any shape requested. For example, cone and cylindrical panels are possible with the present invention, and may be used for applications where irregular designs are needed.

After a blast or explosive event has occurred, the modular system of the blast control blanket allows for relatively low-cost and efficient repair and replacement of damaged sections. Rather than having to demolish damaged parts of a traditional concrete protection system, only the damaged fabric panels 10 and associated parts need to be replaced. Thus, if a particular fabric panel 10 sustains unrepairable damage to the panel body 20, the modular system of the blast control blanket allows for the disengagement of the locking mechanisms 151 in order for the fabric panel 10 to be replaced with a new piece. The locking mechanisms 151 may be reengaged and the blast control system may be put back into use immediately with very little downtime. Furthermore, another benefit provided by the present invention are lowered repair costs for a damaged section of the blast control blanket as compared to traditional blast control systems.

It will be readily apparent to those skilled in the art that the general principles defined herein may be applied to other embodiments and applications without departing from the spirit and scope of the present invention. Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

What is claimed is:

1. A connector assembly for a blast control blanket comprising:

a first fabric panel comprising a high-strength energy absorbing fabric;

a second fabric panel comprising a high-strength energy absorbing fabric, the second fabric panel located adjacent the first fabric panel; and an interlocking connector assembly for securely fastening the first and second fabric panels together, the interlocking connector comprising:

a first tensible wire rope interconnected to the first fabric panel, the first tensible wire rope circumscribing a perimeter of the first fabric panel;

a second tensible wire rope interconnected to the second fabric panel, the second tensible wire rope circumscribing a perimeter of the second fabric panel;

a twist formed between the first and second wire ropes;

a loop formed in the twist between the first and second wire ropes; and, a torque pin located in the loop and secured in place.

2. The connector assembly of claim 1, the first fabric panel substantially quadrilateral in shape.

3. The connector assembly of claim 1, the first fabric panel further comprising an auxetic woven fabric.

4. The connector assembly of claim 1, further comprising a fabric slot attached to the first fabric panel, an end of the torque pin located in the fabric slot.

5. The connector assembly of claim 1, further comprising a fabric pocket attached to the first fabric panel, an end of the torque pin located in the fabric pocket.

6. The connector assembly of claim 1, the first fabric panel further comprising one or more perimeter flaps extending from an edge of the first fabric panel, the one or more perimeter flaps folded inward towards the body of the first fabric panel and attached thereto.

7. The connector assembly of claim 6, the second fabric panel comprising one or more perimeter flaps extending from an edge of the second fabric panel, the one or more perimeter flaps folded inward towards the body of the second fabric panel and attached thereto.

8. The connector assembly of claim 6, the one or more perimeter flaps double stitched to the body of the first fabric panel.

9. The connector assembly of claim 6, the one or more perimeter flaps being substantially quadrilateral in shape.

10. The connector assembly of claim 6, the one or more perimeter flaps forming a perimeter channel circumscribing the first fabric panel.

11. The connector assembly of claim 10, the first fabric panel further comprising a plurality of intermittent channel interruptions formed between the one or more perimeter flaps.

12. The connector assembly of claim 10, the first fabric panel further comprising a plurality of intermittent channel interruptions formed along the edges of the one or more perimeter flaps.

13. The connector assembly of claim 10, the first tensible wire rope located in the perimeter channel.

14. The connector assembly of claim 13, the first tensible wire rope being partially exposed and accessible at each channel interruption.

15. The connector assembly of claim 1, the torque pin comprising a steel rod.

16. The connector assembly of claim 1, wherein the twist comprises approximately 180 degrees of rotation between the first and second wire ropes.

17. A method for connecting two high-strength, energy absorbing fabric panel, the steps comprising:

locating a first side of a first fabric panel adjacent to a first side of a second fabric panel, the first and second fabric panels each having a tensible wire rope circumscribing the length of the perimeter of the fabric panels;

inserting a torque pin into a space between the first side of the first fabric panel and the first side of the second fabric panel;

rotating the torque pin perpendicularly about the tensible wire ropes of the first and second fabric panels by at least 160 degrees of rotation; and, securing the torque pin against the first and second fabric panels.

18. The method of claim 17, further comprising the step of inserting an end of the torque pin into a fabric slot attached to the first fabric panel.

19. The method of claim 17, further comprising the step of inserting an end of the torque pin into a fabric pocket attached to the first fabric panel.

* * * * *